United States Patent [19]

Balanovsky et al.

[11] Patent Number: 4,505,423

[45] Date of Patent: Mar. 19, 1985

[54] NON-ROUND LIQUID-TIGHT PAPER BOARD CONTAINER

[75] Inventors: Lev Balanovsky, Philadelphia, Pa.; Arne H. Brauner, Peekskill, N.Y.

[73] Assignee: International Paper Company, New York, N.Y.

[21] Appl. No.: 441,291

[22] Filed: Nov. 12, 1982

[51] Int. Cl.[3] ..... B65D 3/18

[52] U.S. Cl. ..... 229/5.5; 229/43; 493/102; 493/153; 493/158

[58] Field of Search ..... 229/5.5, 21, 3.1, 4.5, 229/43, 48 T, 48 SB; 156/69, 216; 493/152, 153, 158, 102

[56] References Cited

U.S. PATENT DOCUMENTS

| | | | |
|---|---|---|---|
| 1,006,722 | 10/1911 | Claussen et al. . | |
| 1,094,833 | 4/1914 | Brasch . | |
| 1,498,909 | 6/1924 | Grimm . | |
| 1,713,720 | 5/1929 | Simmons . | |
| 1,916,519 | 7/1933 | Madsen et al. . | |
| 1,968,727 | 7/1934 | Wainwright, Jr. | 229/4.5 |
| 2,014,477 | 9/1935 | Lee | 229/21 |
| 2,032,815 | 3/1936 | Shuey | 229/5.5 |
| 2,053,298 | 9/1936 | Reed | 229/4.5 |
| 2,060,781 | 11/1936 | Annen | 229/52 |
| 2,094,390 | 9/1937 | Warren | 229/5.5 |
| 2,115,745 | 5/1938 | Page | 229/5.5 |
| 2,172,179 | 9/1939 | Rutledge | 229/5.5 |
| 2,190,479 | 2/1940 | Moore | 493/153 X |
| 2,249,052 | 7/1941 | Seiffert | 229/7 |
| 2,301,754 | 11/1942 | Seiffert | 229/4.5 |
| 2,330,840 | 10/1943 | O'Neil et al. | 229/5.5 |
| 2,350,232 | 5/1944 | Hines | 229/5.5 |
| 2,392,959 | 1/1946 | Van Saun | 229/5.5 |
| 2,399,241 | 4/1946 | Merkle | 229/5.5 |
| 2,413,449 | 12/1946 | Hatch | 93/55.1 |
| 2,415,323 | 2/1947 | Wilcox | 93/39.1 |
| 2,608,074 | 8/1952 | Davis | 65/53 |
| 2,789,745 | 4/1957 | Negoro | 229/48 T |
| 2,802,407 | 8/1957 | Majer | 493/158 X |
| 2,820,584 | 1/1958 | Hendry | 229/5.5 |
| 2,884,175 | 4/1959 | Wilson | 229/21 |
| 2,923,453 | 2/1960 | Eckman | 229/43 |
| 2,969,901 | 1/1961 | Behrens | 229/1.5 |
| 3,039,371 | 6/1962 | Leibreich | 229/5.5 X |
| 3,065,678 | 11/1962 | Armstrong | 93/39.1 |
| 3,133,482 | 5/1964 | Armstrong et al. | 493/158 X |
| 3,137,431 | 6/1964 | Crouse et al. | 229/1.5 |
| 3,229,887 | 1/1966 | Fehres et al. | 229/5.5 |
| 3,331,547 | 7/1967 | Gallo | 229/23 |
| 3,369,726 | 2/1968 | Wilcox | 229/5.5 |
| 3,456,564 | 7/1969 | McCandless | 493/158 X |
| 3,583,624 | 6/1971 | Peacock | 229/5.5 |
| 3,606,136 | 9/1971 | Hegardt | 229/43 |

FOREIGN PATENT DOCUMENTS

| | | | |
|---|---|---|---|
| 149686 | 1/1937 | Austria | 229/5.5 |

*Primary Examiner*—William Price
*Assistant Examiner*—Gary E. Elkins
*Attorney, Agent, or Firm*—Richard J. Ancel

[57] ABSTRACT

A liquid-tight paperboard container having at least one radiused corner is disclosed, together with a method for manufacturing it. The container includes a sidewall member having a bottom edge portion folded under a bottom piece to define a flange which is sealed to the bottom piece by means of heat and pressure. The region of the seal between the flange and the bottom piece is defined by a knurled surface on the flange. This permits the formation of a high quality, reliably liquid-tight container using relatively low pressures. In addition, the portions of the bottom edge of the sidewall member adjacent the radiused corners of the container are preferably provided with slits or notches to limit the buckling that occurs during the process of folding the edge under the bottom piece. By doing this, in combination with the use of a knurled for sealing, containers having corners with unusually small radii of curvature be reliably, easily and inexpensively manufactured.

12 Claims, 11 Drawing Figures

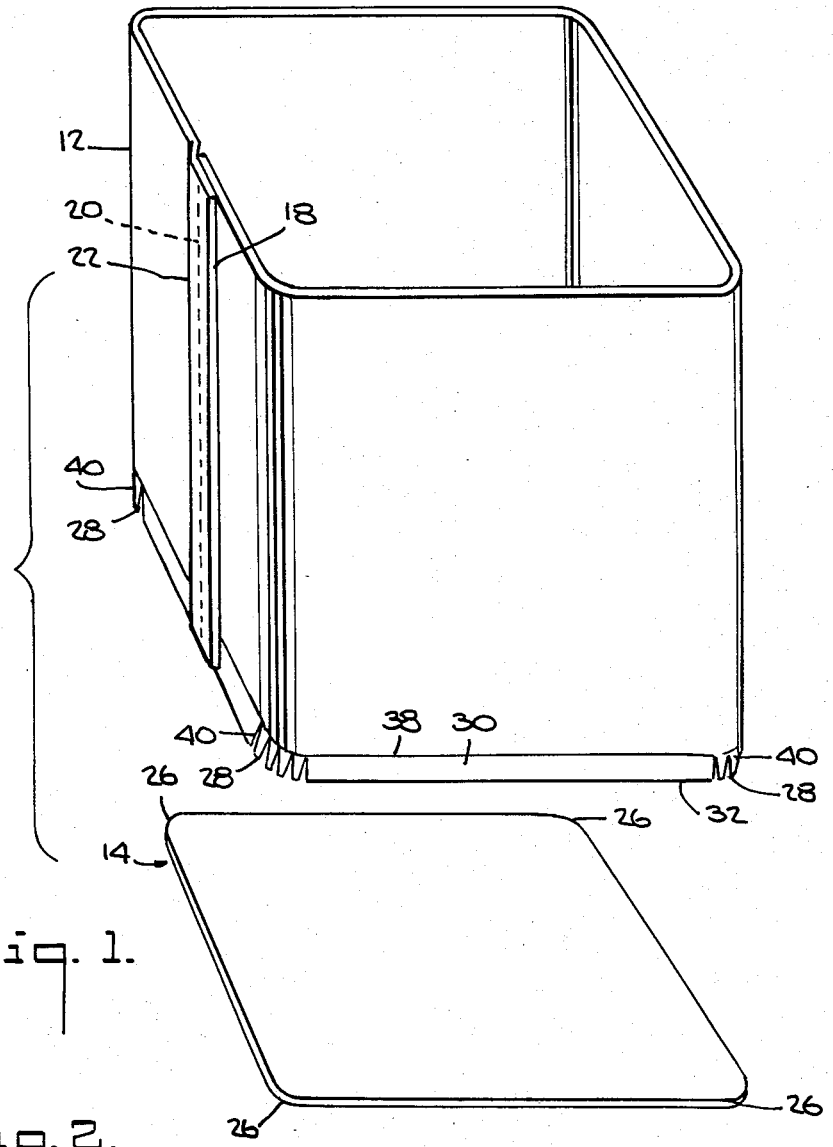
Fig. 1.
Fig. 2.
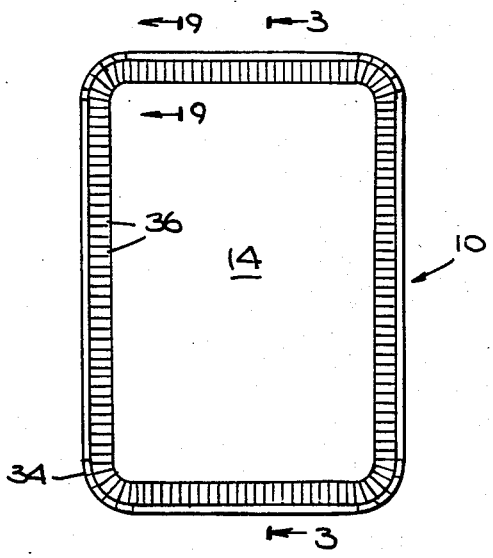
Fig. 3.
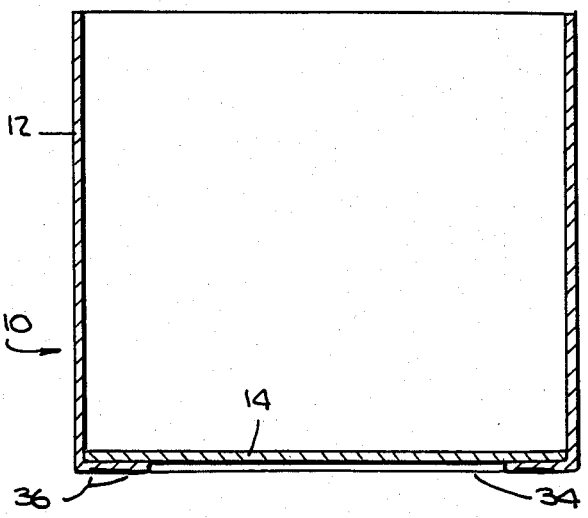

NON-ROUND LIQUID-TIGHT PAPER BOARD CONTAINER

BACKGROUND OF THE INVENTION

The present invention pertains generally to containers made of paperboard or similar materials, and pertains more particularly to liquid tight containers of that type preferably which are non-round in shape having at least one corner with a small radius of curvature.

A number of constructions for round, paperboard, liquid-tight containers are known. Examples are disclosed in U.S. Pat. Nos. 3,369,726 and 3,583,624. Such containers are typically six inches or more in diameter. We have found, however, that when the designs disclosed in the two cited patents or other typical constructions are used for containers having a radius of curvature substantially smaller than about three inches, the result is unacceptable. With smaller radii of curvature, it is difficult or impossible to obtain satisfactory liquid-tight seals with any degree of reliability, and if such a seal can be obtained at all, very high pressures are necessary.

To facilitate the economical storage of products packaged in such containers, it is desirable to provide a reliably liquid-tight container of more angular shape, e.g., a rectangular prism. It is desirable to use radiused corners, rather than right angled corners in such containers. The radius of curvature of such a corner will be far less than the 3 or 3½ inches typical for round containers. As stated, the known methods of constuction are insufficient for this purpose.

SUMMARY OF THE INVENTION

It is therefore the principal object of the present invention to provide a simple, inexpensive, easily made and reliable at least liquid-tight container made of paperboard or the like, and a method for manufacturing it.

Another object of the invention is to provide such a container that can be made with a reliably liquid-tight seal using relatively low pressure for sealing.

Another object of the invention is to provide a method for making such a container, involving a preforming step and a final sealing step, in which the sealing is performed using a tool having a knurled sealing surface, to provide a knurled appearance on a portion of the finished container.

Another object of the invention is to provide such a method in which the container is made from a blank designed to minimize buckling when the blank is formed in the manner required for the radius corners.

Still another object of the invention is to provide a container of the type described having good mechanical stability and a pleasing appearance.

Yet another object of the invention is to provide an easy-to-store container of the type described.

Yet another object of the invention is to provide such a container that is more reliably and securely liquid-tight than is conventionally possible.

Still another object of the invention is to provide a method for constructing such a container, by means of which the double thicknesses of the paperboard stock which occur in the formation of radiused corners can be located or distributed about the perimeter of the container more precisely than is conventionally possible.

Yet another object of the invention is to provide a method for constructing such containers, by means of which it is possible to produce containers having radii of curvature as small as ½ inch.

The container of the invention includes a sidewall member and a bottom piece. The bottom edge portion of the sidewall member is bent inward under the bottom piece to define a flange on which the bottom piece rests. The flange is at least liquid-tightly secured to the bottom piece by means of a pressure and heat seal effected using a tool having a knurled surface. This provides a reliable seal throughout a region that can have any desired width up to the width of the flange and which is preferably a sizable fraction of the total width of the flange. It has been found that, using this construction, it is possible to provide a very secure liquid-tight seal. In addition, the double thicknesses of the stock which occur in the flange at the container corners (or other curved parts of the container) can be controlled and distributed more precisely and evenly using the knurled seal than is conventionally possible. It has also been found that use of this construction requires less pressure in sealing than is the case with conventional constructions and methods.

According to the invention, the parts of the bottom edge portion of the sidewall member that will become the corner regions of the flange are specially prepared to ensure that when the bottom edge portion is folded under the bottom piece to form the flange, the buckling of the flange in the corner regions will be limited to an acceptable level. For this purpose, notches are preferably provided in the bottom edge of the sidewall member. A score line parallel to the bottom edge is usually provided, to demarcate the boundary between the flange and the main portion of the container sidewall. The notches may extend either part way or all the way to the score line. In either case, it is preferable that the notches be of such size and shape that, when the flange is folded, the tabs defined between the notches will overlap each other. This reduces the precision required in fabricating the container. The notches most preferably either extend somewhat less than all the way to the score line, or approximately half of the way.

Another version of the invention uses at least two sets of linear slits in the bottom portion of the sidewall member, each set being inclined at a different oblique angle to the bottom edge. The slits of the two sets preferably alternate.

Alternatively, the slits may be replaced by score lines. In the latter case, the scores may meet to define V's, preferably having their vertices at the edge. The top portions of the V's may meet at or near the horizontal score line, or may be spaced apart from each other.

According to the method of the invention, the side wall is made from a blank, the side edges of which are sealed together liquid-tightly to form a tube. The tube is disposed (and may if desired by initially formed) around an anvil or mandrel having the shape of the final container. The bottom piece is placed on the end of the mandrel, and a preforming tool is placed over the end of the mandrel to push the bottom edge portion of the sidewall member down to form the flange. When this step has been completed, the preforming tool is removed, and a heated sealing tool is placed over the end of the mandrel. This tool has a knurled surface which is pressed against the inner portion of the flange, sealing the latter to the lower surface of the bottom piece by means of a combination of heat and pressure. If desired, the step of forming the sidewall member blank from paperboard or similar stock may include providing such notches, score lines or slits in the bottom edge portion of the side wall member as described above.

These and other features and advantages of the invention will be better understood from a consideration of the following detailed description of several preferred embodiments thereof, taken in conjunction with the accompanying figures, in which like reference characters refer to like elements.

BRIEF DESCRIPTION OF THE FIGURES

FIG. 1 is a partially exploded view of one preferred embodiment of the container of the invention.

FIG. 2 is a bottom view of the completed container of the embodiment of FIG. 1.

FIG. 3 is a cross-sectional view of the finished container, taken from section line 3—3 in FIG. 2.

DETAILED DESCRIPTION OF THE PREFERRED EMBODIMENTS

Figure 6:
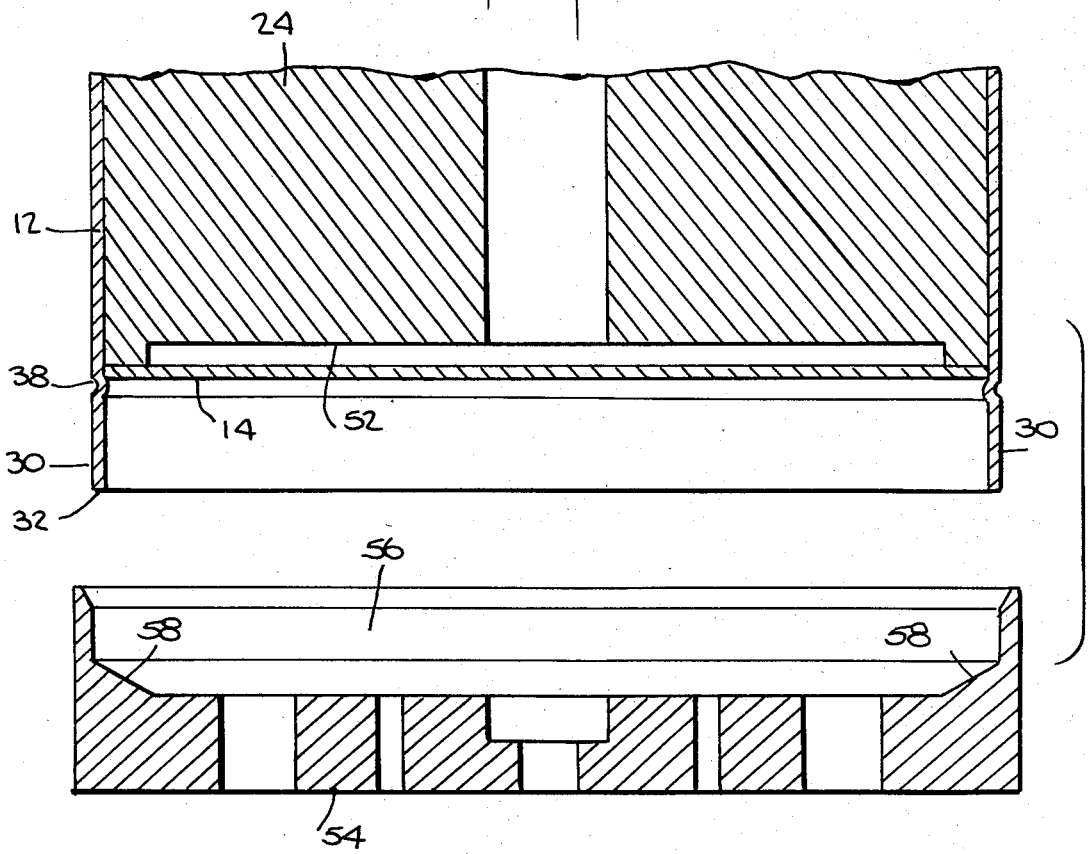
FIGS. 6 and 7 are cross-sectional views of a container in the process of manufacture according to the method of the invention.

FIG. 1 is an exploded view of one preferred embodiment of the container 10 of the invention, including a tubular sidewall 12 and a bottom piece 14. The sidewall 12 is made from a blank 16 (see FIG. 4) formed into a tube of rectangular cross-section by having its two opposite side edges 18, 20 sealed together at 22. This is done in any suitable conventional manner. The tube 12, as shown in FIG. 6 is placed about a mandrel 24 having the same cross-sectional shape as the intended finished container, which is shown as rectangular. It may be convenient to wrap the blank 16 around the mandrel 24 before forming the side seal 22. The bottom piece 14 and sidewall 12 have radiused corners 26, 28. As can be seen, the radius of curvature of the the corners is relatively small. For a typical container of the type herein disclosed, the corners 26, 28 have radii of curvature of about one inch.

The portion 30 of the sidewall 12 adjacent the bottom edge 32 thereof is folded under the bottom piece 14 to define a flange 34, which is sealed by means of heat and pressure to the bottom piece 14. The seal is effected by means of a knurled tool, procuding a knurled seal region 36 on the exposed surface of the flange 34.

Figure 4:
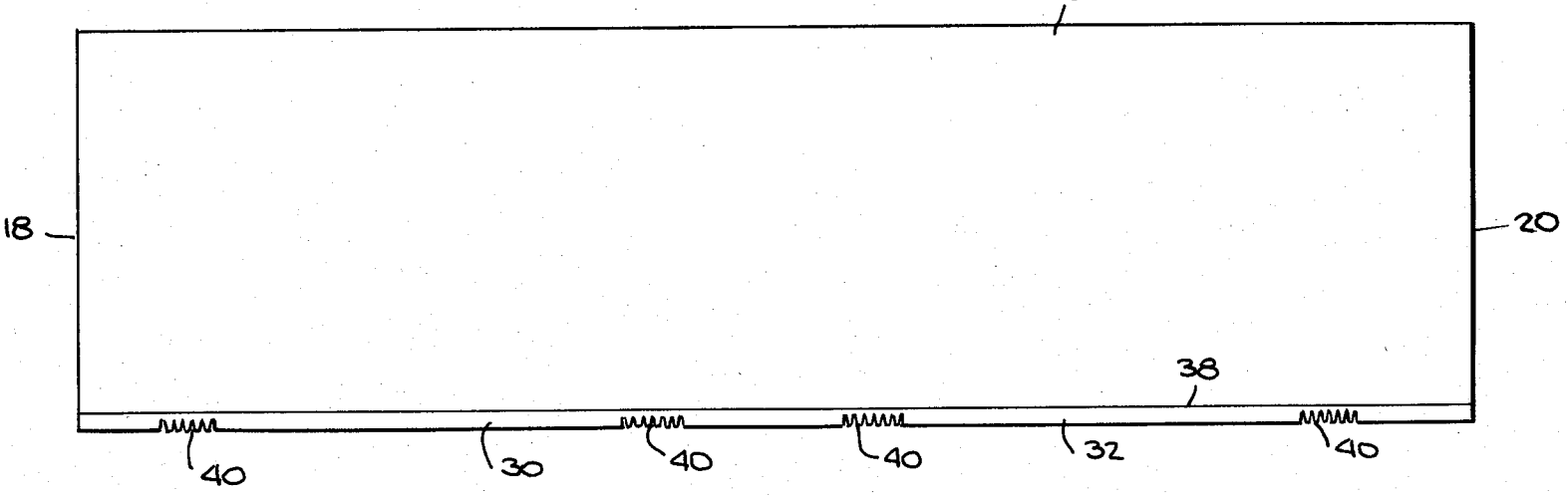
FIG. 4 is a plan view of a sidewall blank for the container of FIGS. 1–3.
Figure 5:
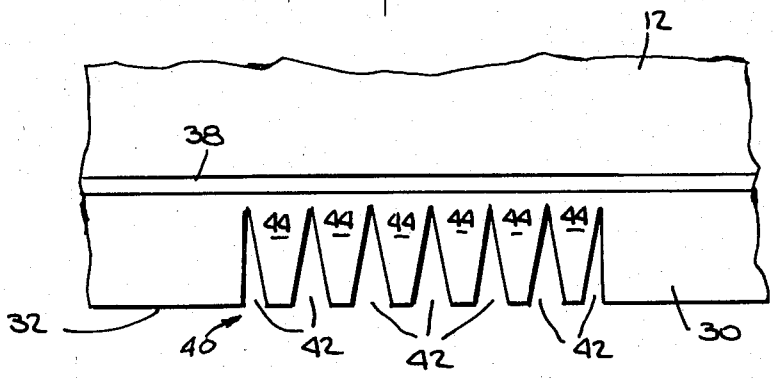
FIG. 5 is a detail of FIG. 2, illustrating the buckling-control elements of the embodiment of FIGS. 1–3.

FIGS. 4 and 5 show a generally rectangular blank 16 of paperboard stock or the like, fabricated by any suitable blank-making techniques, for use in forming the sidewall member 12 of the container 10. The bottom edge portion 30 that will become the flange 34 is preferably demarcated from the remainder of the blank 16 by a score line 38 parallel to the bottom edge 32 of the blank 16. At the four portions of the blank 16 corresponding to the corners of the finished container, buckling-confinement or buckling-limiting elements 40 are provided in the bottom edge portion 30. These localize buckling in the bottom edge portion 30 when the latter is folded under the bottom piece 14 of the container, as described below. The buckling limiting elements function essentially by limiting the size of each buckling or bubble produced by the buckling. As shown in FIG. 5, one preferred embodiment for the buckling isolating performance is a row of V-shaped notches 42 extending from the bottom edge 32 to a point short of the parallel score line 38. As shown, the vertices of the V's may be near, but do not reach the score line 38, and the notches 42 are spaced apart from each other, defining trapezoidal tabs 44 in the bottom edge portion 30. The spacing between the notches 42 is a matter of design choice, as is the exact depth of the notches. These parameters should be chosen to insure that, when the bottom edge portion 30 of the sidewall member 12 is folded to form the flange 34, the tabs 44 defined by the notches 42 overlap. This inssures that there will be no regions of the perimeter of the container 10 without a seal.

Because of the notches 42, any buckling is limited to the tabs 44 in which it occurs. By so confining the buckling, the notches 42 keep the channels caused by the buckling sufficiently small that the knurled sealing tool, described below, can produce a satisfactory seal despite the channels, even with a radius of curvature as small as one inch.

As indicated in FIG. 6, the tubular sidewall 12 is placed (or may be initially formed) around the rectangular mandrel 24, with the horizontal score line 38 immediately beyond the end of the mandrel 24. The bottom piece 14 is then placed on the end of the mandrel 24, just within the horizontal score line 38 of the sidewall member 12. As can be seen, the end face of the mandrel 24 may be slightly recessed as at 52, to provide a recessed surface for the container bottom. A preforming tool 54 is then fitted over the end of the mandrel 24, folding the bottom edge portion 30 of the sidewall member 12 onto the bottom piece 14. The notches 42 in the bottom edge portion 30 cause the corner portions of the flange 34 to buckle in a predicatable, controllable way. Specifically, as stated, no buckling crosses any notch 42 boundary, so that each buckling is limited to a very small area. This tightly limits the size of any possible channel which might form in the flange 34, and by which any moisture or liquid might possibly pass into or out of the container 10. The preforming tool 54 is a block having a bore 56 in one side, the bore 56 having approximately the shape of the bottom of the final container. The internal corner 58 of the bore is chamfered. The chamfer aids in folding down the bottom edge portion 30 of sidewall member 12 when the performing tool 54 is placed over the end of the mandrel 24. This, together with a slight clearance between the side of the bore 56 and the sidewall member 12, prevents breakage of the sidewall member 12 at the boundary between the flange 34 and the sidewall 12.

Figure 7:
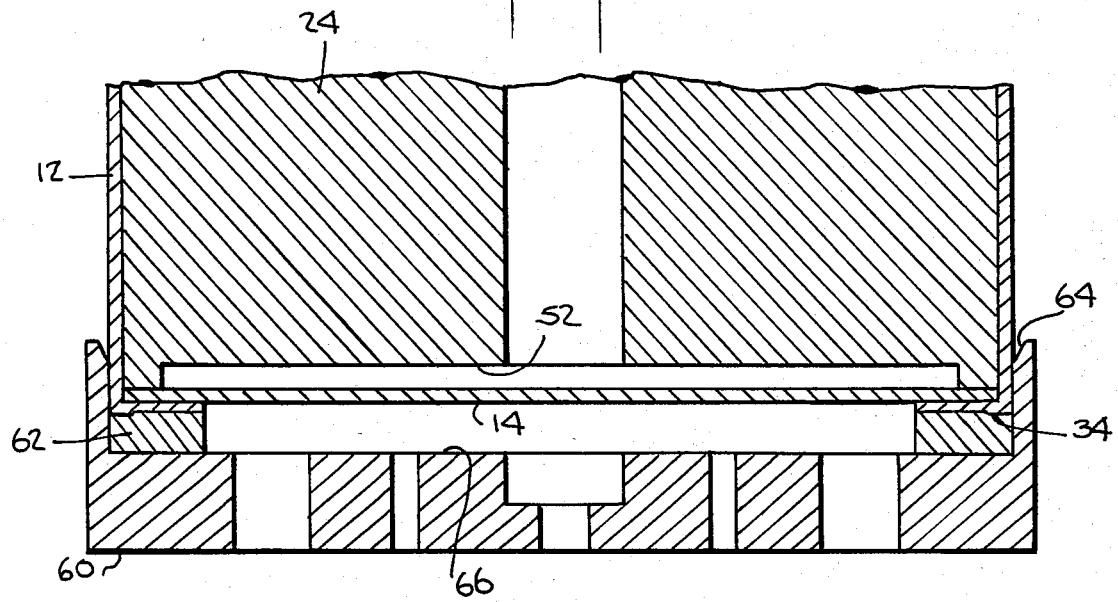
Figure 8:
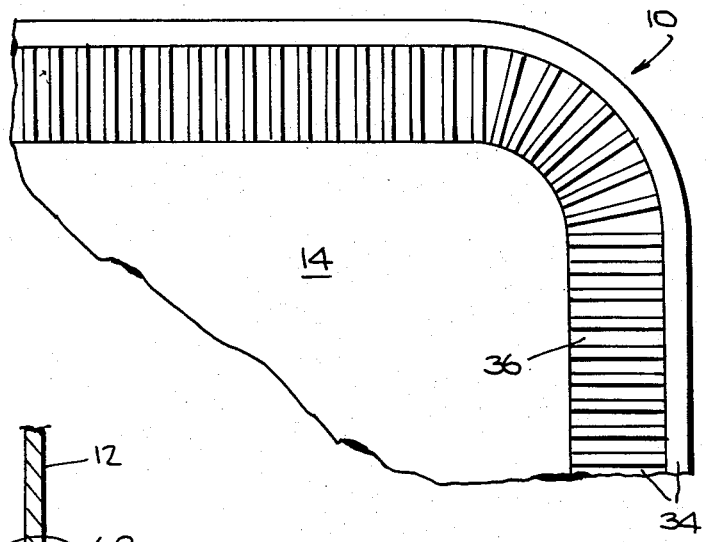
FIG. 8 is a detail of the view of FIG. 2.

As indicated in FIG. 7, after removal of the preforming tool 54, a sealing tool 60 is placed over the end of the mandrel 24. This applies a perimetral knurled surface 62 to the inner portion of the flange 34, heat sealing it to the bottom piece 14. It has been found that, with the knurled surface 62, and effective, liquid-tight seal can be formed in this manner using on the average about one-half the pressure necessary with a flat sealing surface. This produces a corduroy-like effect, as indicated in FIG. 8. The knurls are preferably rounded (radius of curvature of, e.g. 1/6 inch) and alternate with depressions of, preferably, the same size and shape (although these proportions are not shown in FIG. 8). The sealing tool 60 is similar to the preforming tool 54, but does not have the internal chamfer of the latter. (A slight chamfer 64 may, however, be provided at the mouth of the bore 66 of the sealing tool.) The knurled sealing surface of the sealing tool 60 has, of course, the same perimetral shape as the flange 34, although the sealing surface is typically narrower than the flange 34. In the preferred embodiment shown, the knurling takes the form of ridges or ribs, which are oriented to point between the outer perimeter and inner perimeter of the flange 34.

A slight clearance is necessary between the side portions of the sealing tool 60 and the sidewall member 12, to prevent breaking of the stock at the fold. The clearance is sufficiently small, however, that the bottom piece 14 meets the interior wall at more or less exactly a ninety degree angle. Some slight upward bend of the bottom piece 14 against the wall (with the container in its upright position) is acceptable, as long as this is slight enough that the edge 68 of the bottom piece 14 is not exposed to the container contents. This makes the entire outer surface of the flange 34 quite flat, except for the knurling, providing excellent stability and a pleasing appearance. The width of the knurled area is typically a large fraction of the width of the flange 34, and may be approximately equal to the flange width, if desired. This assures secure sealing that will not deteriorate. The width of the knurled area should preferably be a minimum of 3/16 inch. Both the knurled area and flange may have any larger dimension, as desired.

It has been found that the use of such a sealing tool 60 concentrates the sealing force in such a manner that substantially less force is necessary than with conventional flat sealing surfaces. The use of such a surface, it has been found, precisely controls and distributes the double-thickness portion of the paperboard stock in the corner regions. These features make for a more durable, more reliable seal, and the lower pressure required in the manufacturing process reduces the cost of the latter. In addition, use of the knurls has been found to permit the reliable, liquid-tight sealing of the flange to the bottom piece, even in corner regions with a relatively small radius (e.g., 1.5 inches), even without the buckling-limiting elements.

Figure 9:
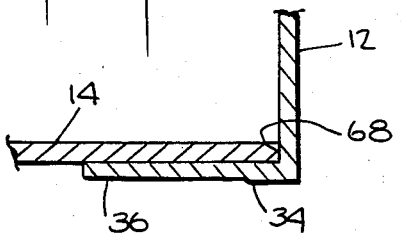
FIG. 9 is a detail of a cross-sectional view of the completed container, taken from section line 9—9 of FIG. 2.

As indicated in FIG. 9, the bottom piece 14 is very precisely dimensioned, so that its edge 68 is flat against the interior surface of the sidewall member 12. This prevents exposure of the bottom edge 68 to the contents. When laminate stock having waterproof outer layers, but one or more paper inner layers, is used, this is essential to prevent deterioration of the container.

Figure 10:
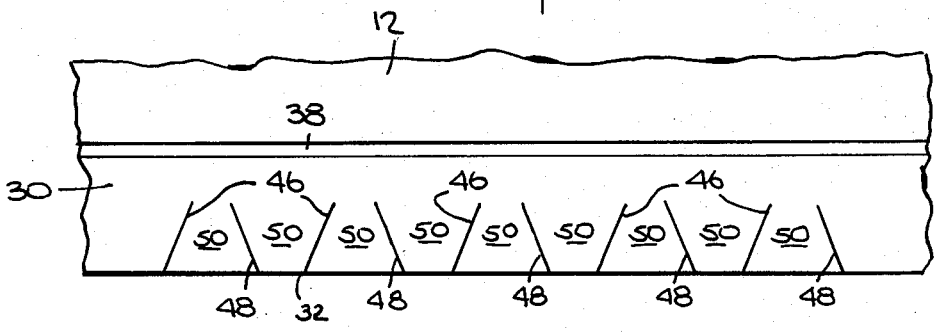
FIGS. 10 and 11 are view like that of FIG. 5 showing alternate embodiments of the container of the invention.
Figure 11:
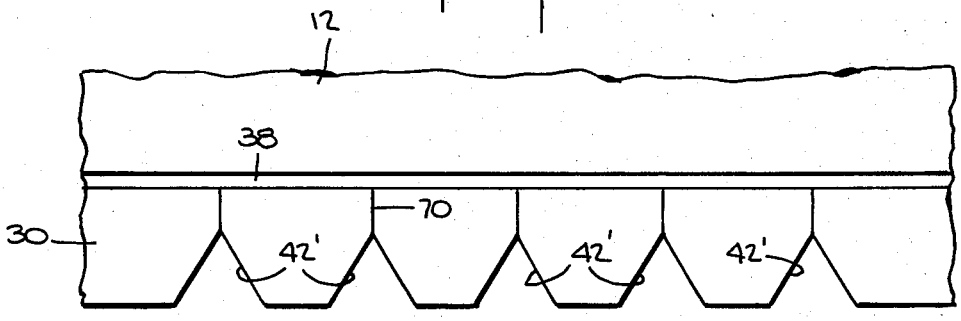

FIGS. 10 and 11 show variations of the buckling limiting elements 40. In FIG. 11, the notches 42' extend half way, approximately, from the bottom edge 32 toward horizontal score line 38, and have short scores or slits 70 extending from the notch vertex toward the score line 38, preferably perpendicularly to the edge 32. Instead of the short scores or slits, however, oblique scores defining V's that straddle each notch, and that preferably have their vertices on score line 38, may be provided. In FIG. 10, slits 46, 48 are provided in the bottom edge portion 30. The slits 46, 48 are arranged at oblique angles to the bottom edge 32. One set of slits 46 is arranged at one oblique angle, while the other set 48 is arranged at another oblique angle, which may be the supplement of the first. The slits of the two sets alternate, so that each pair of adjacent slits defines between them a trapezoidal tab 50, alternating tabs having the short or the longer base, respectively, at the bottom edge 32 of the blank 16.

In the embodiment of FIG. 10, score lines could be provided instead of slits. In this version, the oblique score lines may extend all the way to the horizontal score line 38, although this is not necessary. The score lines may meet at the score line 38 or elsewhere to define V's. The V's may be spaced apart or may abut each other, or may be oriented with their vertices at the bottom edge 32 and their tops at the score line 38.

In all the variations of the embodiments of FIGS. 10 and 11, the slits or score lines serve as barriers to buckling of the flange 34. Although buckling occurs, it cannot cross a slit or score line. The size of the "bubbles" of material formed by the buckling is limited by the slits or scores. The regions of the flange 34 can be further subdivided by additional scores, further limiting buckling.

Although the present invention has been described in detail with reference to several preferred embodiment, many variations and modifications of these will now be apparent to those skilled in the art. Accordingly, the scope of the invention is to be limited, not by the details of the illustrative embodiments described, but only by the terms of the appended claims.

What is claimed is:

1. A container of paperboard or the like, comprising a sidewall member; and a bottom piece, which defines the bottom of said container;

said side wall member having at least one radiused portion and a bottom edge portion, wherein said bottom edge portion comprises buckling-confinement means in the area of said at least one radiused portion, said buckling-confinement means comprising cut-outs in said bottom edge portion adjacent said bottom edge, said cut-outs comprising V-shaped notches, wherein said bottom edge portion is demarcated from the remainder of said side-wall member by means of a score line approximately parallel to said bottom edge, and wherein said notches extend to a point short of said score line from said bottom edge, said buckling-confinement means further including a slit extending from the vertex of each said notch;

wherein said bottom edge portion of said sidewall member is folded under said bottom piece to define a flange in contact with said bottom piece and sealed thereto throughout a sealing region of said flange; said sealing region having a radially buckled surface and providing a liquid tight seal, wherein said buckling-confinement means limit the buckling that can occur when said bottom edge portion is folded under said bottom piece.

2. The container of claim 1, wherein said notches extend approximately half-way to said parallel score line.

3. The container of claim 1, wherein said bottom piece has a perimeteral edge abutting the interior of said side-wall member at substantially a 90° angle.

4. The container of claim 1, wherein the radius of said at least one radiused portion is substantially less than approximately 3 inches.

5. The container of claim 4, wherein the radius of said at least one radiused portion is less than approximately 1 inch.

6. The container of claim 2, wherein the radius of said at least one radiused portion is less than approximately 1 inch.

7. A container of paperboard or the like, comprising a sidewall member; and a bottom piece, which defines the bottom of said container;

said side wall member having at least one radiused portion and a bottom edge portion, wherein said bottom edge portion comprises buckling-confinement means in the area of said at least one radiused portion, said buckling-confinement means comprising cut-outs in said bottom edge portion adjacent said bottom edge, said cut-outs comprising V-shaped notches, wherein said bottom edge portion is demarcated from the remainder of said side-wall member by means of a score line approximately parallel to said bottom edge, and wherein said notches extend to a point short of said score line from said bottom edge, said buckling-confinement means further including a score line extending from the vertex of each said notch;

wherein said bottom edge portion of said sidewall member is folded under said bottom piece to define a flange in contact with said bottom piece and sealed thereto throughout a sealing region of said flange; said sealing region having a radially buckled surface and providing a liquid tight seal, wherein said buckling-confinement means limit the buckling that can occur when said bottom edge portion is folded under said bottom piece.

8. The container of claim 7, wherein said notches extend approximately half-way to said parallel score line.

9. The container of claim 7, wherein said bottom piece has a perimeteral edge abutting the interior of said side-wall member at substantially a 90° angle.

10. The container of claim 7, wherein the radius of said at least one radiused portion is substantially less than approximately 3 inches.

11. The container of claim 10, wherein the radius of said at least one radiused portion is less than approximately 1 inch.

12. The container of claim 8, wherein the radius of said at least one radiused portion is less than approximately 1 inch.

* * * * *